US007028423B1

(12) United States Patent
Curry

(10) Patent No.: US 7,028,423 B1
(45) Date of Patent: Apr. 18, 2006

(54) SNOWPLOW BLADE LIFTING MECHANISM

(76) Inventor: Floyd E. Curry, 837 Avonia Rd., Fairview, PA (US) 16415

( * ) Notice: Subject to any disclaimer, the term of this patent is extended or adjusted under 35 U.S.C. 154(b) by 0 days.

(21) Appl. No.: 10/902,201

(22) Filed: Jul. 28, 2004

(51) Int. Cl.
*E01H 5/04* (2006.01)

(52) U.S. Cl. ..... 37/236; 37/266

(58) Field of Classification Search ..... 37/232, 37/266, 231, 234, 235, 264; 172/817, 811
See application file for complete search history.

(56) References Cited

U.S. PATENT DOCUMENTS 1,385,153 A * 1/1921 Clark ..... 37/231
1,776,788 A * 9/1930 Gettelman ..... 37/232
2,094,515 A * 9/1937 Abbe ..... 37/232
2,302,516 A * 11/1942 Ball ..... 37/232
4,947,563 A * 8/1990 Pfister, Jr. ..... 37/231
5,044,098 A * 9/1991 Berghefer ..... 37/232
5,920,477 A 7/1999 Hoffberg et al.
6,088,937 A * 7/2000 DiClementi et al. ..... 37/232
6,581,306 B1 * 6/2003 DiClementi et al. ..... 37/231
6,711,837 B1 * 3/2004 Bloxdorf et al. ..... 37/231
6,892,480 B1 * 5/2005 Gledhill et al. ..... 37/232

* cited by examiner

*Primary Examiner*—Victor Batson
(74) *Attorney, Agent, or Firm*—Richard K. Thomson

(57) ABSTRACT

The blade lifting mechanism includes a counterbalance offsetting the weight of the snowplow blade assembly and enabling the double-acting actuator to position the blade much more easily. IN a first embodiment, heavy duty download pressure springs in conjunction with a toggle link enable the downward force on the blade to be varied between a value which is a fraction of the weight of the blade to an amount which is several multiples of the magnitude of the weight of the blade assembly. In a second embodiment, the toggle link is replaced by a linear slide link.

20 Claims, 4 Drawing Sheets

4"
14
10
4
18
4b
4'
13
3a
5
8
12
2'
19
2
15
3

SNOWPLOW BLADE LIFTING MECHANISM

BACKGROUND AND SUMMARY OF THE INVENTION

The present invention is directed to the field of snow removal. More particularly, the present invention is directed to a snowplow blade lift mechanism which combines a counterbalance system with an actuation system which permits variable downward pressure to be applied to the blade.

Traditionally, snowplow blades have been bulky and heavy to maintain contact with the road no matter what obstruction was encountered and to endure the stresses and strains of snow removal. These snowplow blades were mounted on an articulated linkage and raised and lowered via some type of actuator. The full weight of the snowplow blade would engage the ground each time the snowplow was used. For most applications, this resulted in excessive downward pressure producing excessive wear of the blade, as well as the road, over-working the drive components, and resulting in excessive fuel consumption. With the rising cost of fuel, this inefficient system is in need of an overhaul.

The present lifting mechanism is designed for use with snowplow blades made with high strength, light weight materials. The lighter weight blade can, then, be mounted on a smaller, more fuel efficient vehicle and can be manipulated by a more efficient, less costly actuator. The lifting mechanism of the present invention employs a counterbalance system which, in one preferred embodiment, employs a plurality of coil springs connected between a push frame upon which the snowplow blade is mounted and a mounting frame attached to frame of the vehicle. The force administered by the counterbalance springs is variable by reconfiguring adjustment means, which in one embodiment is a turnbuckle, associated with each counterbalancing spring.

One end of a double-acting actuator is pivotally connected to the push frame and the other end is connected to the mounting frame by means of a toggle link. In at least one position midway in the travel of the actuator, the counterbalance springs bear the total weight of the push frame and snowplow blade and the actuator can be disconnected from the toggle link, if necessary, e.g., for actuator replacement. Since only a fractional amount of the weight of the snowplow blade assembly needs to be moved, the actuator can be smaller and its operation more efficient. The actuator moves the snowplow blade between a first retracted travel position and a second extended plowing position. In the first fully retracted position, the inboard end of the toggle link engages a stop pin which prevents further counterclockwise rotation of the toggle link resisting bouncing movement of the snowplow blade during transit with the stiffness of the mounting frame.

Once the blade is engaged with the road surface, variable downward pressure can be exerted on the blade edge. The downward pressure is variable between extremes of less than the weight of the snowplow blade to significantly more than the weight of the blade. This is made possible by additional extension of the actuator after the blade is in contact with the road, extending heavy duty spring means and, effectively, transferring a portion of the vehicular weight to the blade edge. This can assist in breaking ice or hard packed snow when needed. The downward pressure can be reduced for normal conditions and additionally reduced for soft road surfaces such as gravel. The snowplow blade is additionally equipped with a break-over pivot connection and a break-over spring which biases the snowplow blade back against a stop block. Should the blade encounter an immovable obstruction, the blade (or some portion thereof) can pivot forward against the force of the spring while simultaneously rising against the force of the download spring to prevent damage to the blade and the actuator.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
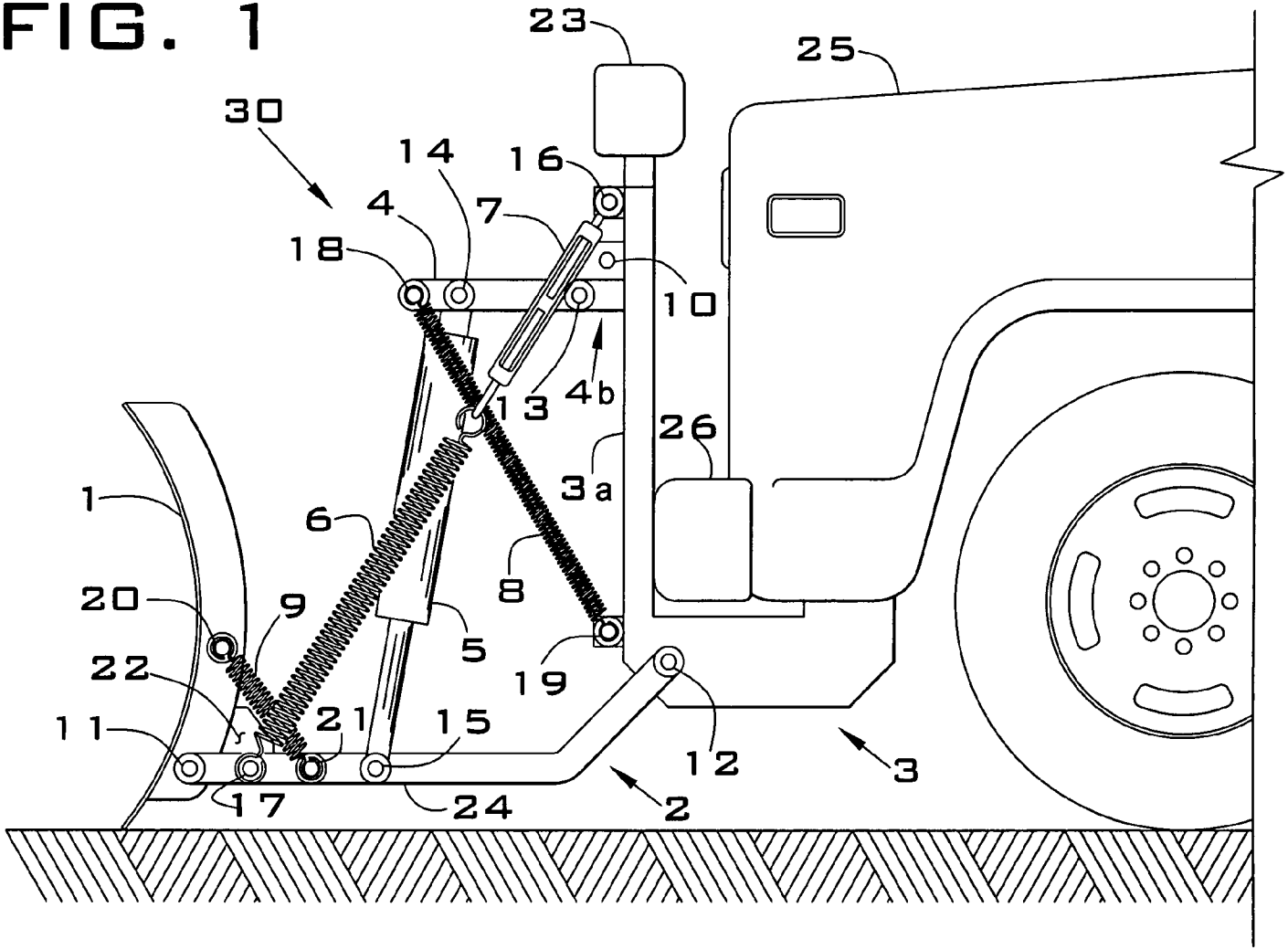
FIG. 1 is a schematic side view of a first embodiment of the snowplow blade lifting mechanism of the present invention.
Figure 3A:
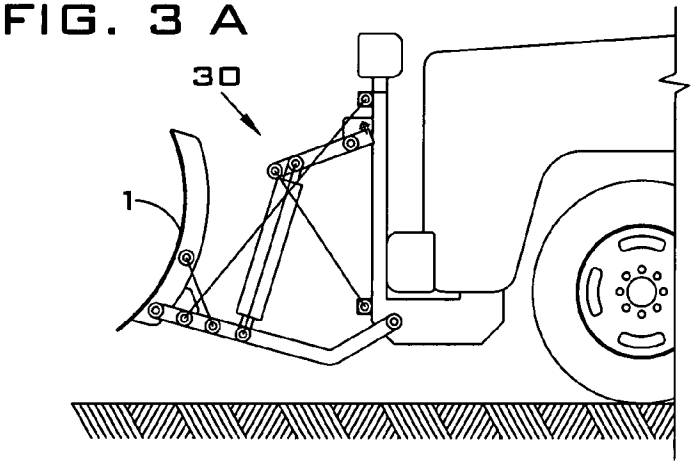
FIG. 3A is a schematic side view of the lift mechanism in its first retracted travel position.
Figure 3B:
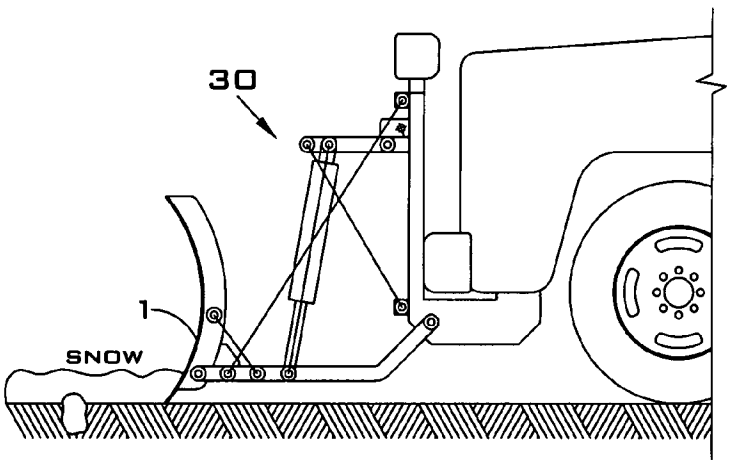
FIG. 3B is a schematic side view of the lift mechanism in its second extended plowing position.
Figure 3C:
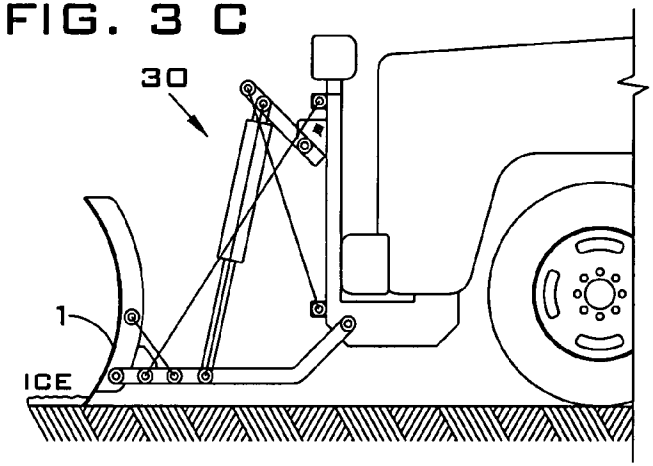
FIG. 3C is a schematic side view of the lift mechanism applying increase downward pressure on the snowplow blade for combating ice, for example.
Figure 3D:
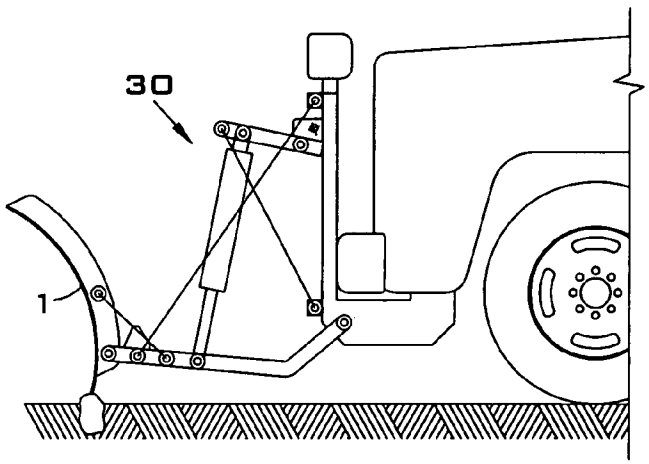
FIG. 3D is a schematic side view depicting the break-over safety feature working in conjunction with the download pressure springs to protect the blade and the actuator from damage from an obstruction.

The lift mechanism for a snowplow blade is shown in FIG. 1 generally at 30. Snowplow blade 1 is mounted on push frame 2 by break over hinge pin 11. Break over spring 9 biases blade 1 rearwardly against stop block 22. This mounting enables blade 1 (or some portion of it) to pivot when it engages an immovable object (FIG. 3D) protecting the blade 1 and the actuator 5 from damage. Push frame 2 has a pair of side supports 24 (only one shown). Mounting frame 3 is secured to the frame of the truck or other vehicle 25 and has an arm 3*a* which rises in front of the bumper 26 of vehicle 25.

The weight of the snowplow blade 1 and the push frame 2 is counterbalanced by at least one coil spring 6 which is provided with adjustment means, in this case, a turnbuckle 7. The counterbalance system is interconnected between push frame 2 (at connection point 17) and mounting frame 3 (at mounting point 16). It will be understood that although the preferred embodiment is comprised of a pair of coil springs 6 and turnbuckles 7, one coil spring 6 connected to each of the side supports 24, other configurations are possible. For example, three coil springs could be employed which are configured to be actuated at different times in the travel of the blade assembly. Further, other types of springs and adjustment means could be substituted for the coil springs 6 and turnbuckle 7 shown here without departing from the spirit of the invention.

Actuator 5 is connected between push frame 2 and mounting frame 3. Although lower actuator pin 15 is schematically depicted as attached to side support 24, actuator pin 15 is connected to a laterally extending frame member (not shown) which interconnects the two side supports 24. Actuator 5 is necessarily of the double-acting type. In the preferred embodiment, actuator 5 is a double acting hydraulic cylinder, although it will be understood any other suitable double-acting actuator such as pneumatic cylinder, feed screw, ball screw, rack and pinion, or the like, could be used with equal success.

Figure 2:
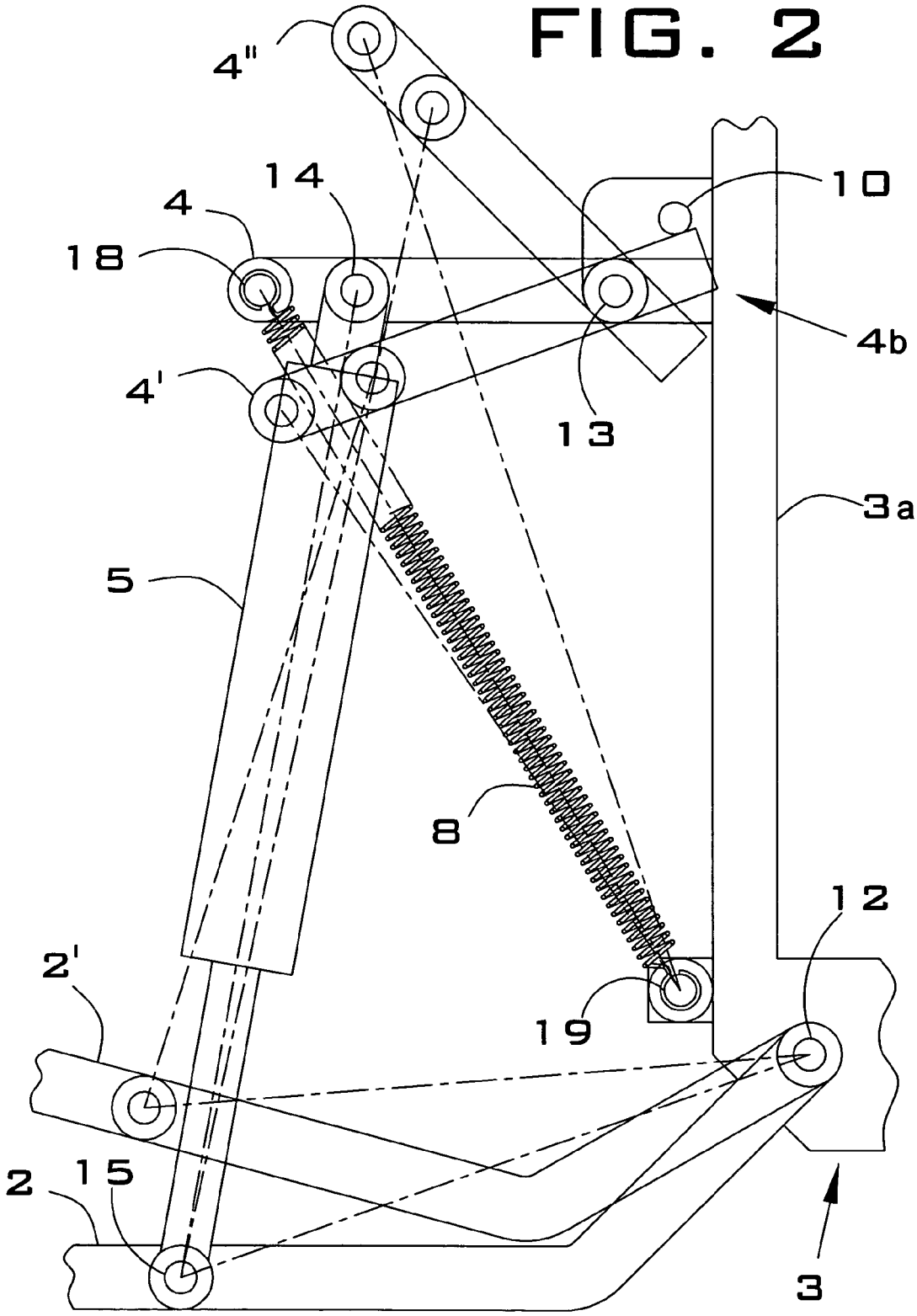
FIG. 2 is an enlarged side view of the actuator linkage.

The upper actuator pin 14 is connected to a toggle link 4 which is pivotally attached to mounting frame arm 3*a* by link pin 13. As best seen in FIG. 2, toggle link has a trailing end portion 4*b* behind link pin 13 which, in the limits of its counterclockwise rotation pegs against stop pin 10. This engagement takes place when the actuator 5 is in its fully collapsed position and the snowplow blade 1 and push frame 2 are in their first retracted travel position. As seen in FIG. 2, push frame is in the 2' position and toggle link is in the 4' position. Engagement of end portion 4*b* with stop pin 10 enables the mounting frame 3 and, specifically, the stiffness of frame arm 3*a*, to resist downward movement (bouncing) of the blade assembly. When snowplow blade 1 is in the operative position, push frame will have the position indicated by 2 and toggle link position indicated by 4 (FIG. 2). In this position, the force on snowplow blade 1 is less than its weight, counterbalance springs 6 still bearing most of the weight of the blade assembly.

A pair of heavy duty coil springs 8 are connected between the mounting frame 3 at 19 and leading end 4*a* of toggle link 4 at 18. These springs are in an at rest position when the push frame and toggle link are in the 2, 4 position depicted in FIG. 2. By extending actuator 5 beyond this neutral position, toggle link is lifted to position 4". This stretches heavy duty, download pressure springs 8 effectively transferring a portion of the weight of the vehicle 25 to snowplow blade 1.

Depending on the amount of the extension of actuator 5, the downward pressure on blade 1 can be varied from an amount significantly less than the weight of the blade assembly to a level which exceeds its weight by a factor of 2 (or more, dependent on the stiffness and degree of deflection of springs 8). Auxiliary head lamps 23 are shown mounted atop mounting frame arm 3*a* for improved visibility.

The lift mechanism 30 of the present invention provides a unique opportunity to advance the state of snowplow technology beyond its current capabilities. The antiquated notion that the blade needs to be bulky, which then drives the size and expense of the actuator up, necessitates the use of a larger vehicle to maneuver, results in undue downward pressure for most plow operation, and excessive fuel consumption, is tossed out the window. High strength, light weight materials can be used to form the snowplow blade 1, push frame 2, and mounting frame 3. Counterbalance springs 6 enable the choice of a smaller, more efficient actuator 5 since only a fraction of the weight of the blade assembly is being moved thereby. The download pressure springs 8 in conjunction with toggle link 4, enable the downward pressure on blade 1 to be varied between a fraction of the weight of the blade assembly to an amount which is several times the magnitude of the weight. The resulting system is far more flexible and efficient in accomplishing the task and permit the vehicle used to achieve significantly greater fuel efficiency, while reducing drive train wear, increasing maneuverability and reducing road wear.

Figure 4:
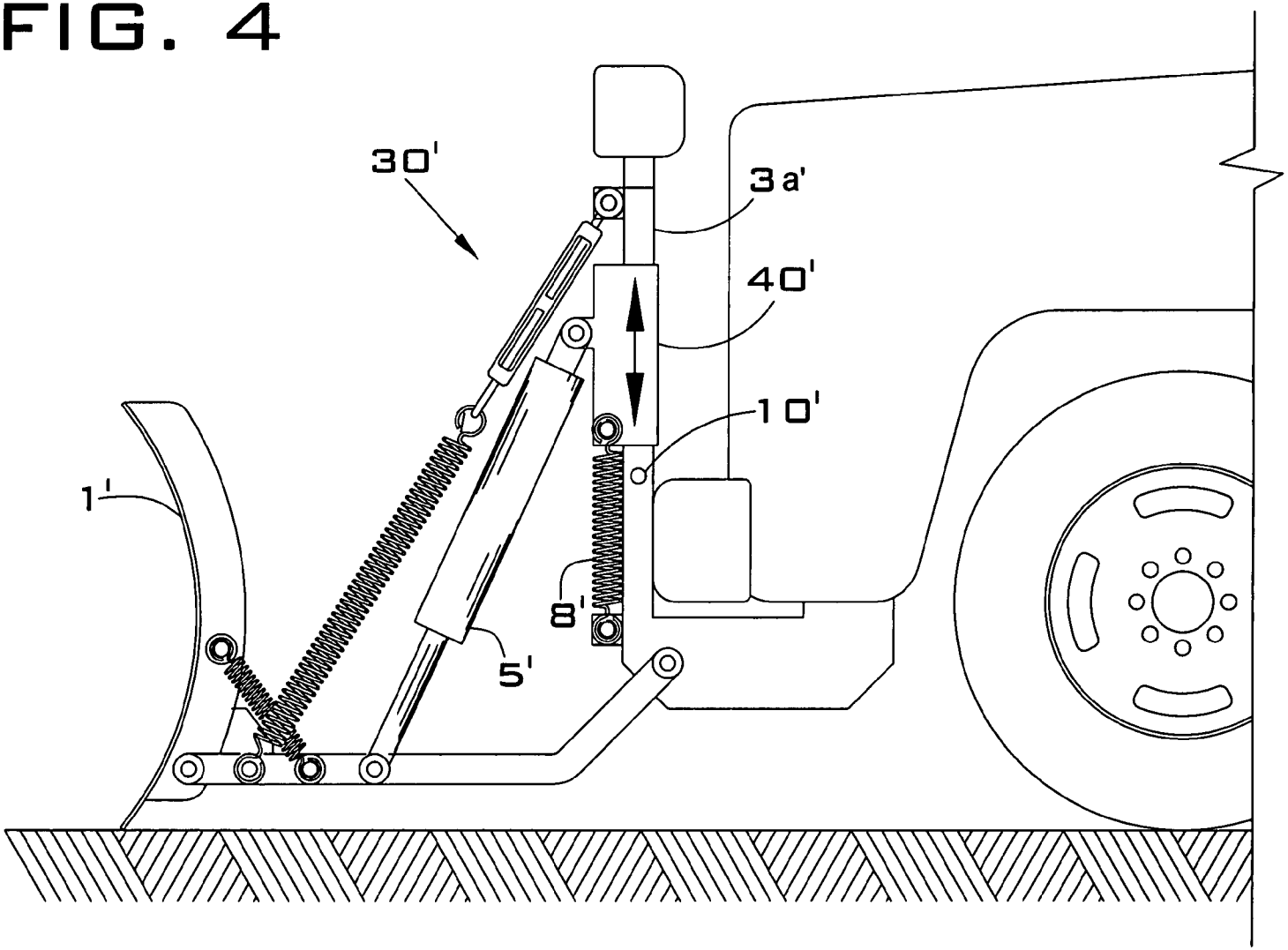
FIG. 4 is a schematic side view of a second preferred embodiment.

A second preferred embodiment of the lifting mechanism of the present invention is depicted in FIG. 4 generally at 30'. In this embodiment, rather than a toggle link, a linear slide link 40' is mounted to reciprocate vertically on frame arm 3*a*'. This second embodiment works in all particulars like the first embodiment. When snowplow blade 1' engages the ground and actuator 5' is extended further, download spring 8' will variably increase the downward pressure exerted on snowplow blade 1' to the desired amount. This increase will be linear in all respects as the heavy duty spring 8' is extended. Stop pin 10' limits the downward motion of slide link 40' so as not to compress spring 8'.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. Apparatus for providing variable downward force on a snowplow blade comprising:

a) a mounting frame attached to a support vehicle;

b) a push frame attached between said mounting frame and the snowplow blade;

c) counterbalance means offsetting an entire weight of said push frame and the snowplow blade;

d) a toggle link pivotally connected to said mounting frame;

e) spring means downwardly biasing said toggle link;

f) an actuator connected between said push frame and said toggle link for moving the snowplow blade between a first retracted travel position and a second extended plowing position;

whereby said actuator is required to produce minimal force to move said push frame with the snowplow blade up and down.

2. The apparatus of claim 1 wherein said counterbalance means comprises first spring means attached between said push frame and said mounting frame.

3. The apparatus of claim 2 wherein said first spring means comprises a plurality of coil springs.

4. The apparatus of claim 3 wherein said push frame has first and second side supports and said plurality of coil springs comprises a pair of coil springs, one engaging each side support of said push frame.

5. The apparatus of claim 4 wherein said spring means further comprises means to adjust a force exerted by said spring means on said side support of said push frame.

6. The apparatus of claim 5 wherein said means to adjust comprises a pair of turn buckles, one of said pair of turn buckles attached to each of said pair of coil springs.

7. Apparatus for providing variable downward force on a snowplow blade comprising:

a) a mounting frame attached to a support vehicle;

b) a push frame attached between said mounting frame and the snowplow blade;

c) counterbalance means offsetting a weight of said push frame and the snowplow blade;

d) an actuator connected between said push frame and said mounting frame for moving the snowplow blade between a first retracted travel position and a second extended plowing position;

e) means to transfer at least a portion of a vehicular weight to downward pressure on said push frame and the snowplow blade;

whereby said actuator means is required to produce minimal force to move said push frame with the snowplow blade up and down.

8. The apparatus of claim 7 wherein said means to transfer at least a portion of the vehicular weight comprises a double-acting actuator and heavy duty spring means.

9. The apparatus of claim 8 wherein said means to transfer further comprises a linear slide link to which said heavy duty spring means and said double-acting actuator is attached, whereby extending said double-acting actuator beyond a point in which the snowplow blade contacts a ground surface actuates said linear slide link allowing said heavy duty spring means to variably increase downward pressure on the snowplow blade.

10. The apparatus of claim 8 wherein said means to transfer further comprises a toggle link to which said double-acting actuator and said heavy duty spring means are attached, whereby extending said double-acting actuator beyond a point in which the snowplow blade contacts a ground surface actuates said toggle link allowing said heavy duty spring means to variably increase downward pressure on the snowplow blade.

11. The apparatus of claim 10 further comprising means to lock said toggle link against rotary movement in at least one rotational direction when said snowplow blade is in said first retracted travel position to reduce bouncing.

12. The apparatus of claim 1 further comprising a break-over pivot connection between the snowplow blade and said push frame whereby encountering an obstruction permits the snowplow blade to pivot eliminating damage thereto and to said actuator.

13. The apparatus of claim 12 further comprising a stop block and break-over spring means which biases the snowplow blade into an upright position against said stop block.

14. Apparatus for providing variable downward force on a high strength, light weight snowplow blade comprising a) a mounting frame attached to a support vehicle;

b) a push frame attached between said mounting frame and the snowplow blade;

c) a double-acting actuator connected between said push frame and said mounting frame for moving the snowplow blade between a first retracted travel position and an extended plowing position;

d) heavy duty spring means connected between said push frame and said mounting frame exerting a downward force on said push frame;

e) means to transfer a portion of a weight of the support vehicle to down pressure on the snowplow blade;

whereby variable downward pressure can be exerted on the high strength, light weight snowplow blade from an amount less than a weight of said snowplow blade to a value several times the weight of the snowplow blade.

15. The apparatus of claim 14 further comprising means to counterbalance an entire combined weight of said push frame and the snowplow blade.

16. The apparatus of claim 15 wherein said means to counterbalance comprises spring means interconnected between said push frame and said mounting frame.

17. The apparatus of claim 16 further comprising means to adjust a counterbalance force provided by said spring means.

18. The apparatus of claim 17 wherein said means to adjust the counterbalance force comprises at least one turn buckle.

19. The apparatus of claim 14 further comprising a toggle link connected between said double acting actuator and said mounting frame, said heavy duty spring means also be connected thereto.

20. The apparatus of claim 14 further comprising a linear slide link interconnected between said double acting actuator and said mounting frame, said heavy duty spring means also be connected thereto.

* * * * *